US010706802B2

(12) United States Patent
Wei et al.

(10) Patent No.: US 10,706,802 B2
(45) Date of Patent: Jul. 7, 2020

(54) DISPLAY DEVICE

(71) Applicant: AU OPTRONICS CORPORATION, Hsin-chu (TW)

(72) Inventors: Chen-Yang Wei, Hsin-chu (TW); Hsiang-Pin Fan, Hsin-chu (TW); Wen-Hao Hsu, Hsin-chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 136 days.

(21) Appl. No.: 15/499,501

(22) Filed: Apr. 27, 2017

(65) Prior Publication Data

US 2017/0337889 A1 Nov. 23, 2017

(30) Foreign Application Priority Data

May 20, 2016 (TW) ..... 105115751 A

(51) Int. Cl.
*G09G 3/36* (2006.01)

(52) U.S. Cl.
CPC ..... *G09G 3/3677* (2013.01); *G09G 3/3648* (2013.01); *G09G 2310/0205* (2013.01); *G09G 2310/08* (2013.01)

(58) Field of Classification Search
CPC ... G09G 3/3674; G09G 3/3677; G09G 3/3681
See application file for complete search history.

(56) References Cited

U.S. PATENT DOCUMENTS

2002/0186196 A1* 12/2002 Park ..... G09G 3/3677 345/100
2008/0297676 A1* 12/2008 Kimura ..... G02F 1/13624 349/39
2014/0375627 A1* 12/2014 Kim ..... G09G 3/3677 345/214
2015/0187297 A1 7/2015 Park

FOREIGN PATENT DOCUMENTS

CN 101533597 A 9/2009
CN 102237061 B 12/2013
CN 104751812 A 7/2015

OTHER PUBLICATIONS

Office Action issued by the State Intellectual Property Office of the Peoples Republic of China dated Mar. 15, 2018 for Application No. CN 201610556909.4.
Office Action issued by (TIPO) Intellectual Property Office, Ministry of Economic Affairs, R. O. C. dated Nov. 23, 2016 for Application No. 105115751, Taiwan.

* cited by examiner

*Primary Examiner* — Alexander Eisen
*Assistant Examiner* — Cory A Almeida
(74) *Attorney, Agent, or Firm* — Tim Tingkang Xia, Esq.; Locke Lord LLP

(57) ABSTRACT

A display device includes a plurality of pixels, a plurality of gate lines, a timing controller, and a gate driver. The gate lines are electrically coupled to the pixels. The timing controller provides an initial pulse signal. The gate driver is electrically coupled to the timing controller and the gate (Continued)

lines and receives the initial pulse signal. The gate driver receives the initial pulse signal with a high level and outputs a plurality of gate signals to the gate lines during a period which is longer than half of a frame of the display device, in response to a scan frequency of the display device changing from a first frequency to a second frequency, where the first frequency is higher than the second frequency.

7 Claims, 9 Drawing Sheets

DISPLAY DEVICE

CROSS-REFERENCE TO RELATED PATENT APPLICATION

This application claims the benefit of priority to Taiwan Patent Application No. 105115751, filed May 20, 2016. The entire content of the above identified application is incorporated herein by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD

The present invention relates to a display technology, and in particular, to a display device.

BACKGROUND

When a display device displays an image, sometimes a screen defect occurs. For example, a fracture or tearing occurs on the screen. This situation occurs because the number of image frames output by a video card of a computer is asynchronous with a scan frequency of the display device.

To solve the problem above, a vertical synchronization (V-Sync) function is developed in the industry. However, when the screen defect is solved by means of V-Sync, a problem of display lag is further incurred. Hence, an adaptive vertical synchronization (G-Sync) function is further developed in the industry, so as to solve the screen defect without incurring the problem of display lag.

As can be seen, apparently, the existing manners described above are still inconvenient and defective. To solve the problem above, those in related fields have tried hard to find a solution, but have not yet succeeded in developing a suitable solution so far.

SUMMARY

A certain technical aspect of the content relates to a display device, including a plurality of pixels, a plurality of gate lines, a timing controller and a gate driver. The plurality of gate lines is electrically coupled to the pixels. The timing controller is configured to provide an initial pulse signal. The gate driver is electrically coupled to the timing controller and the gate lines and configured to receive the initial pulse signal. The gate driver receives the initial pulse signal with a high level and outputs gate signals to the gate lines during a period which is longer than half of a frame period of the display device, in response to a scan frequency of the display device changing from a first frequency to a second frequency, where the first frequency is higher than the second frequency.

In certain embodiments, the gate driver includes a driving circuitry. The driving circuitry is configured to receive a clock signal, and the driving circuitry outputs the clock signal to one of the gate lines as one of the gate signals according to the initial pulse signal with the high level.

In still certain embodiments, the driving circuitry includes an input end, an output end, and a switch. The input end is configured to receive the initial pulse signal, and the output end is configured to output one of the gate signals. The switch includes a first end, a control end, and a second end. The first end of the switch is configured to receive the clock signal, the control end of the switch is coupled to the input end, and the second end of the switch is coupled to the output end. The switch is configured to be conductive according to the initial pulse signal with the high level, so that the clock signal is transmitted from the first end to the second end, and the output end outputs the clock signal as one of the gate signals.

In still certain embodiments, in response to the scan frequency of the display device changing from the first frequency to the second frequency, the timing controller provides the initial pulse signal with the high level during a period which is longer than half of the frame period of the display device, and correspondingly switches the clock signal from a third frequency to a fourth frequency, the third frequency being lower than the fourth frequency.

Another aspect of the content relates to a display device, including a plurality of pixels, a plurality of gate lines, a timing controller and a gate driver. The plurality of gate lines is electrically coupled to the pixels. The timing controller is configured to provide an initial pulse signal. The gate driver is electrically coupled to the timing controller and the gate lines, and is configured to receive the initial pulse signal. The initial pulse signal has a first width when a scan frequency of the display device is a first frequency, the initial pulse signal has a second width when the scan frequency of the display device is a second frequency, the first frequency is higher than the second frequency, the second width is greater than the first width, and the gate driver is further configured to output gate signals to the gate lines according to the initial pulse signal.

In certain embodiments, the second width is greater than twice the first width.

In still certain embodiments, the gate driver includes a driving circuitry. The driving circuitry is configured to receive a clock signal, and the driving circuitry outputs the clock signal to one of the gate lines as one of the gate signals according to the initial pulse signal with a high level.

In still certain embodiments, the driving circuitry includes an input end, an output end, and a switch. The input end is configured to receive the initial pulse signal, and the output end is configured to output one of the gate signals. The switch includes a first end, a control end, and a second end. The first end of the switch is configured to receive the clock signal, the control end of the switch is coupled to the input end, and the second end of the switch is coupled to the output end. The switch is configured to be conductive according to the initial pulse signal with the high level, so that the clock signal is transmitted from the first end to the second end, and the output end outputs the clock signal to the gate lines as one of the gate signals.

In further certain embodiments, in response to the scan frequency of the display device changing from the first frequency to the second frequency, the timing controller provides the initial pulse signal with the high level during a period which is longer than half of the frame period of the display device, and correspondingly switches the clock signal from a third frequency to a fourth frequency, the third frequency being lower than the fourth frequency.

Another aspect of the content of relates to a display device, including a plurality of pixels, a plurality of gate lines, a timing controller and a gate driver. The plurality of gate lines is electrically coupled to the pixels. The timing controller is configured to provide an initial pulse signal. The gate driver is electrically coupled to the timing controller and the gate lines, and is configured to provide the gate lines gate signal and receive the initial pulse signal. The gate driver is configured to change a frequency of the gate signals from a third frequency to a fourth frequency, the third frequency being lower than the fourth frequency, in response to a scan frequency of the display device changing from a first frequency to a second frequency, the first frequency being higher than the second frequency.

In certain embodiments, the gate driver includes a driving circuitry. The driving circuitry is configured to receive a clock signal, and the driving circuitry outputs the clock signal to one of the gate lines as one of the gate signals according to the initial pulse signal with a high level.

In certain embodiments, the driving circuitry includes an input end, an output end and a switch. The input end is configured to receive the initial pulse signal, and the output end is configured to output one of the gate signals. The switch includes a first end, a control end, and a second end. The first end of the switch is configured to receive the clock signal, the control end of the switch is coupled to the input end, and the second end of the switch is coupled to the output end. The switch becomes conductive according to the initial pulse signal with the high level, so that the clock signal is transmitted from the first end to the second end, and the output end outputs the clock signal to the gate lines as one of the gate signals.

With reference to the implementation manners below, a person of ordinary skill in the technical field can easily understand the basic spirit and other invention objectives, as well as the technical means and implementation manners adopted.

BRIEF DESCRIPTION OF THE DRAWINGS

To make the foregoing and other objectives, features, advantages, and embodiments easier to understand, the accompanying drawings are described as follows.

Figure 1:
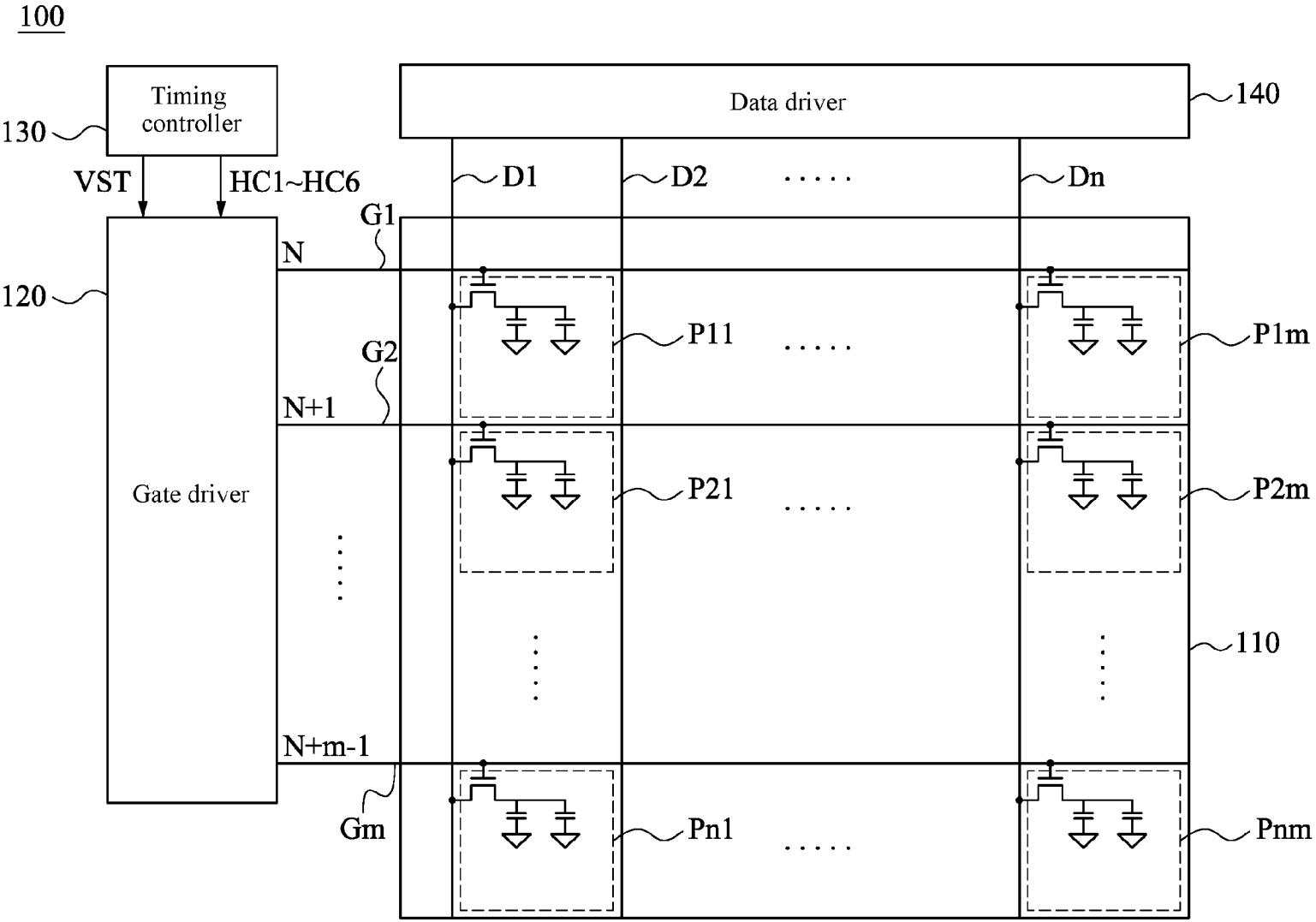
FIG. 1 is a schematic diagram of a display device according to an embodiment.

According to a common operation manner, the features and elements in the drawings are not drawn proportionally, and the drawing manner is intended to present, in an optimal manner, specific features and elements. In addition, same or similar reference numerals are used to represent similar elements/parts among different figures.

DETAILED DESCRIPTION

To make the description of the present disclosure more comprehensive and complete, illustrative descriptions specific to implementation manners and specific embodiments are provided below. However, this is not the only implementation or application form of the specific embodiments. The implementation manners cover features of a plurality of specific embodiments, method steps for constructing and operating these specific embodiments, and a sequence of the steps. However, other specific embodiments may also be used to implement same or equivalent functions and step sequence.

Unless otherwise defined in the specification, meanings of the scientific and technological terms used herein are the same as meanings understood and commonly used by a person of ordinary skill in the technical field. In addition, the noun in singular form used in the specification contains the plural form of the noun as long as it does not conflict with the context; and the noun in plural form used in the specification also contains the singular form of the noun.

In addition, the term "coupling" used herein may refer to direct physical or electrical contact between two or more elements, or indirect physical or electrical contact between two or more elements, and may also refer to mutual operations or actions between two or more elements.

To solve a screen defect that occurs occasionally when a display device displays an image, a vertical synchronization (V-Sync) technology or an adaptive vertical synchronization (G-Sync) technology is used in the industry. When the foregoing technology is adopted, if a polymer stabilized alignment (PSA) mode liquid crystal array is used in combination with a color filter on array (COA) pixel architecture, due to an orientation polarization effect, a value of capacitance in pixels rises as the frequency declines, causing a capacitor undercharge, and as a result, the brightness of the display device decreases. Certain embodiments provide a display device and a driving method, for the related problem of a decrease in brightness caused by a capacitance change in pixels due to the orientation polarization effect. Detailed descriptions are provided below.

FIG. 1 is a schematic diagram of a display device according to an embodiment. As shown in FIG. 1, a display device 100 includes a plurality of pixels P11 to Pnm, a plurality of gate lines G1~Gm, a plurality of data lines D1~Dn, a gate driver 120, a timing controller 130, and a data driver 140. In terms of a connection relationship, the gate lines G1~Gm and the data lines D1~Dn are respectively electrically coupled to the pixels P11 to Pnm. The gate driver 120 is electrically coupled to the timing controller 130 and the gate lines G1~Gm. The data driver 140 is electrically coupled to the data lines D1~Dn.

Figure 2:
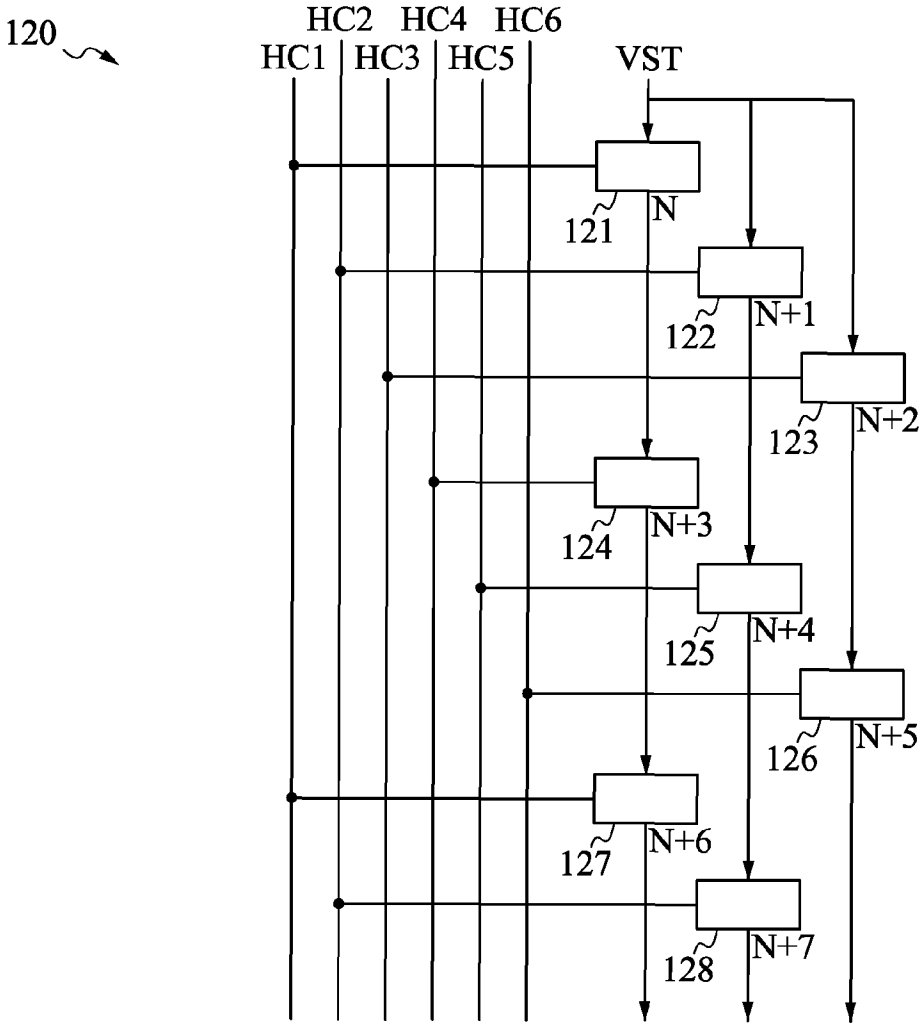
FIG. 2 is a schematic diagram of a gate driver of the display device shown in FIG. 1 according to another embodiment.
Figure 3A:
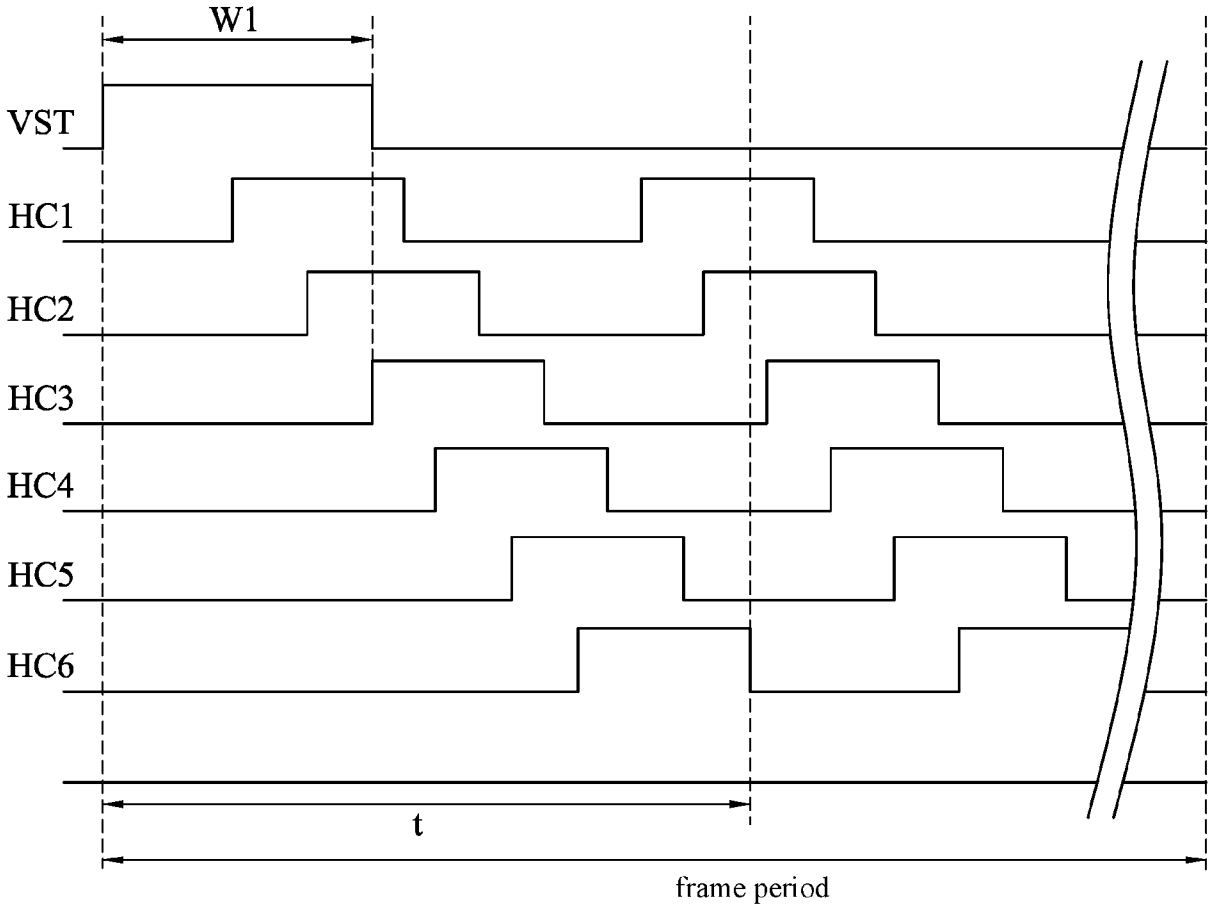
FIG. 3A is a schematic diagram of a driving waveform according to still another implementation manner.
Figure 3B:
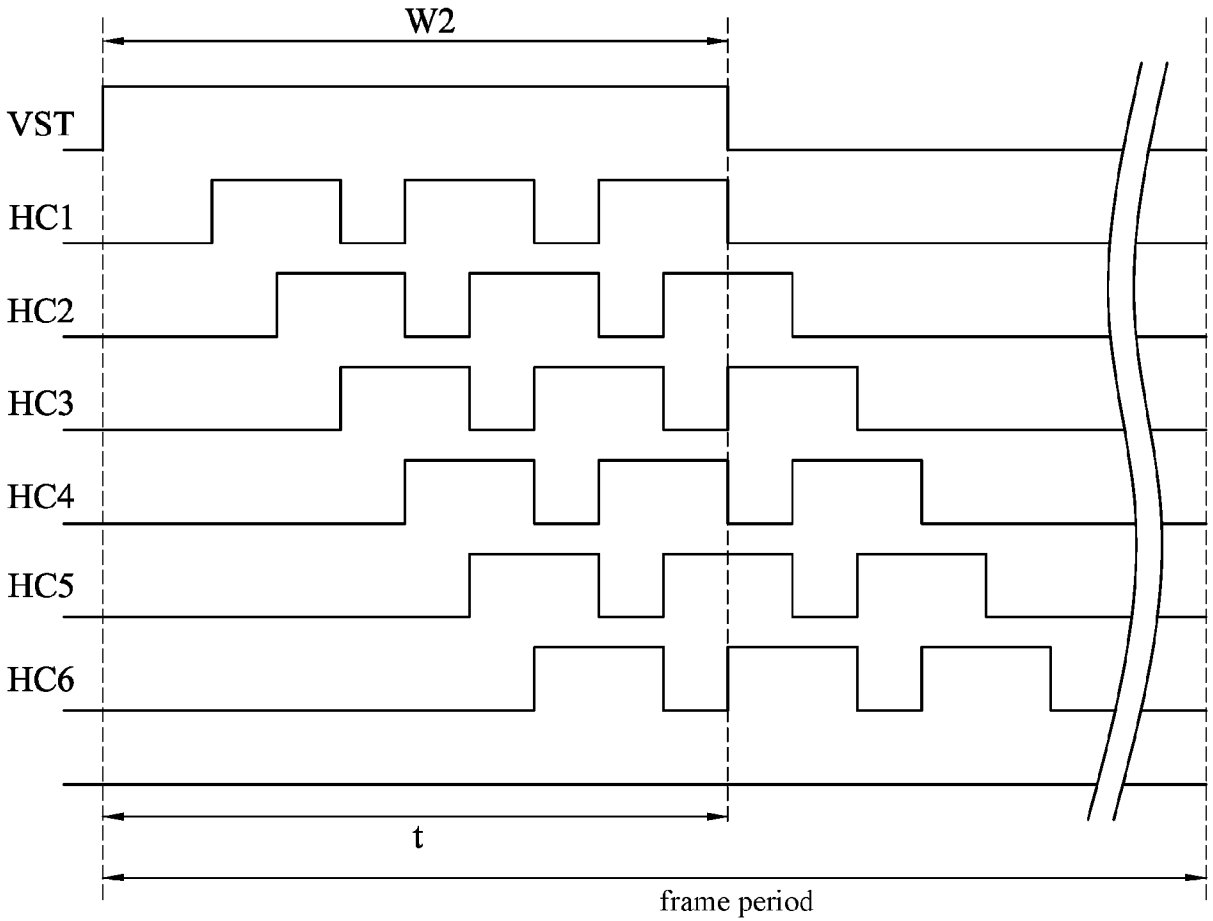
FIG. 3B is a schematic diagram of a driving waveform according to further another implementation manner.
Figure 3C:
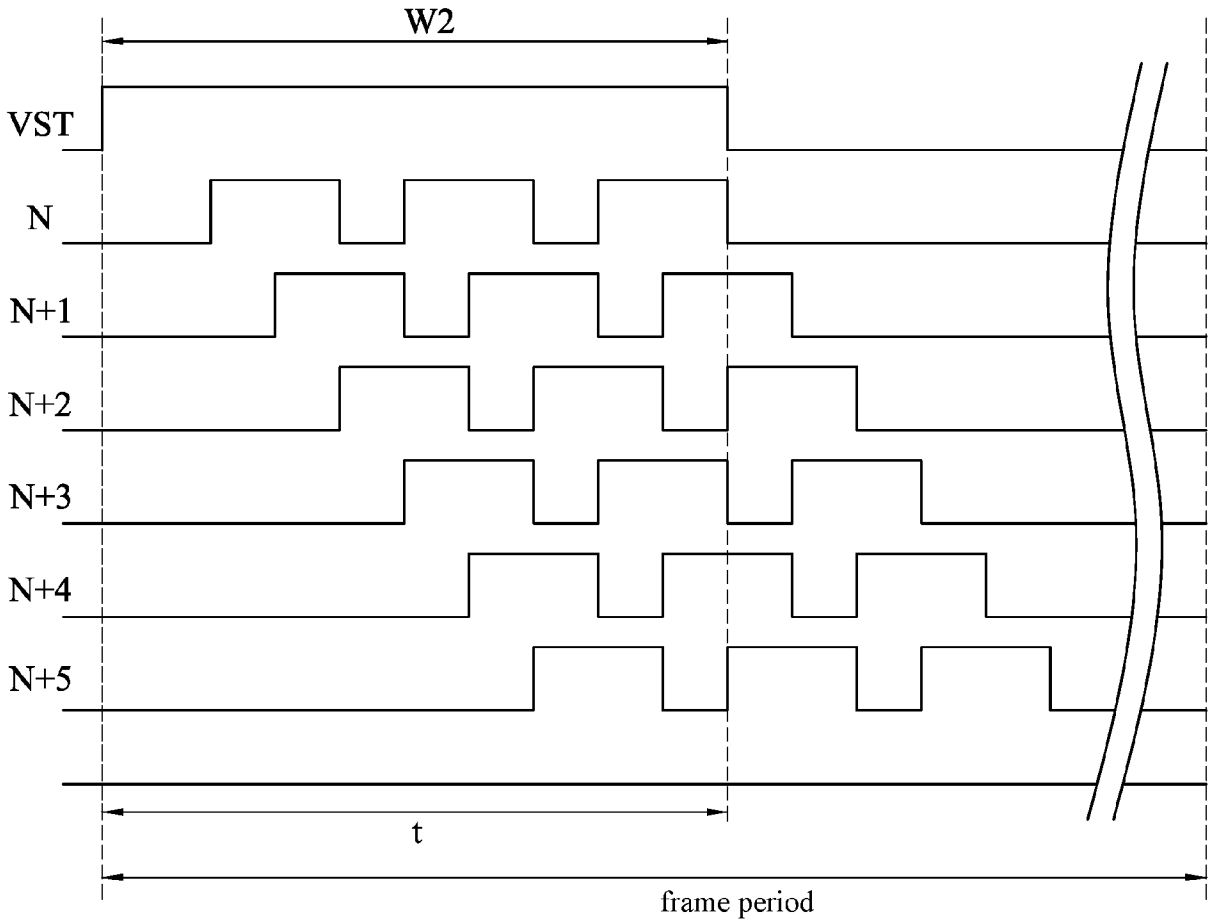
FIG. 3C is a schematic diagram of a gate signal waveform according to still another implementation manner.

To understand the operation manner of the display device 100 shown in FIG. 1 more easily, please refer to FIG. 2, FIG. 3A, FIG. 3B, and FIG. 3C together. FIG. 2 is a schematic diagram of the gate driver 120 of the display device 100 shown in FIG. 1 according to another embodiment. FIG. 3A is a schematic diagram of a driving waveform when a scan frequency of the display device 100 is a first frequency, and FIG. 3B is a schematic diagram of a driving waveform when the scan frequency of the display device 100 is a second frequency. FIG. 3C illustrates a gate signal waveform output by the gate driver 120 of the display device 100 according to the driving waveform in FIG. 3B.

Please refer to FIG. 2. The gate driver 120 includes a plurality of driving circuitries 121 to 128. In terms of operations, please refer to FIG. 1 and FIG. 2 together. The timing controller 130 is configured to provide an initial pulse signal VST. The driving circuitries 121 to 128 of the gate driver 120 are configured to receive clock signals HC1~HC6, and output the clock signals HC1~HC6 to the corresponding gate lines G1~Gm as gate signals N to N+m−1 according to the initial pulse signal VST. Besides the driving circuitries 121 to 128, the gate driver 120 may further include more driving circuitries. For example, driving circuitries at the $N^{th}$ stage and the $(N+6)^{th}$ stage receive the clock signal HC1, driving circuitries at the $(N+1)^{th}$ stage and the $(N+7)^{th}$ stage receive the clock signal HC2, driving circuitries at the $(N+2)^{th}$ stage and the $(N+8)^{th}$ stage receive the clock signal HC3, driving circuitries at the $(N+3)^{th}$ stage and the $(N+9)^{th}$ stage receive the clock signal HC4, driving circuitries at the $(N+4)^{th}$ stage and the $(N+10)^{th}$ stage receive the clock signal HC5, and driving circuitries at the $(N+5)^{th}$ stage and the $(N+11)^{th}$ stage receive the clock signal HC6. In an embodiment, the driving circuitries 121 to 128 of the gate driver 120 are configured to receive the initial pulse signal VST, and the driving circuitries 121 to 128 of the gate driver 120 are configured to receive the initial pulse signal VST with a high level and output the clock signals HC1~HC6 to the corresponding gate lines G1~Gm as the gate signals N to N+m−1 according to the initial pulse signal VST during a period which is longer than half of a frame period of the display device 100 (the period t as shown in FIG. 3B), in response to the scan frequency of the display device 100 changing from the first frequency (as shown in FIG. 3A) to the second frequency (as shown in FIG. 3B), where the first frequency is higher than the second frequency.

In other words, when the scan frequency of the display device 100 changes from the first frequency (as shown in FIG. 3A) to the second frequency (as shown in FIG. 3B) and the first frequency is higher than the second frequency, the driving circuitries 121 to 128 of the gate driver 120 receive the initial pulse signal VST with the high level provided by the timing controller 130 and output the clock signals HC1~HC6 to the gate lines G1~Gm as the gate signals N to N+m−1 according to the initial pulse signal VST during the period t which is longer than half of a frame period of the display device 100, as shown in FIG. 3B. For example, a frequency range of the first frequency is approximately 140 Hz to 150 Hz. In another embodiment, a frequency range of the second frequency is approximately 25 Hz to 35 Hz.

In this way, referring to FIG. 3B, in response to a decrease in the scan frequency of the display device 100, the gate driver 120 receives the initial pulse signal VST with the high level and outputs the clock signals HC1~HC6 to the gate lines G1~Gm as the gate signals N to N+m−1 according to the initial pulse signal VST during the period t, which is longer than half of a frame period of the display device 100, so that liquid crystals in the display device 100 can have a longer time to reach a stable state according to an electric field generated by the gate lines G1~Gm driving the pixels P11 to Pnm. When the liquid crystals in the display device 100 reach the stable state, the orientation polarization affects the capacitance in pixels less, so that the capacitor can be charged more fully and no severe brightness decrease is incurred in the display device 100.

In an embodiment, referring to FIG. 3A, when the scan frequency of the display device 100 is the first frequency, the initial pulse signal VST provided by the timing controller 130 has a first width W1. Referring to FIG. 3B, when the scan frequency of the display device 100 is the second frequency, the initial pulse signal VST provided by the timing controller 130 has a second width W2. Please refer to FIG. 3A and FIG. 3B together. It is noted that, duration of one frame period is the same in the two figures. In a case where the first frequency is higher than the second frequency, it can be learned from the figures that, the second width W2 is greater than the first width W1, and a frequency of the clock signals HC1~HC6 in FIG. 3B is higher than a frequency of the clock signals HC1~HC6 in FIG. 3A. The gate driver 120 is configured to output the gate signals N to N+m−1 to the gate lines G1~Gm according to the initial pulse signal VST having the second width W2. In still another embodiment, please refer to FIG. 2, FIG. 3B and FIG. 3C together. The driving circuitries 121 to 128 of the gate driver 120 correspondingly output the gate signals N to N+5 shown in FIG. 3C according to the clock signals HC1~HC6 shown in FIG. 3B.

In another embodiment, the second width W2 is greater than triple of the first width W1. In still another embodiment, the second width W2 is greater than twice of the first width W1. In further another embodiment, the second width W2 is greater than 1.5 times of the first width W1. However, the present invention is not limited to the foregoing embodiments, and during implementation of the present invention, a proper ratio of the second width W2 to the first width W1 can be selectively adopted according to an actual requirement.

Figure 4:
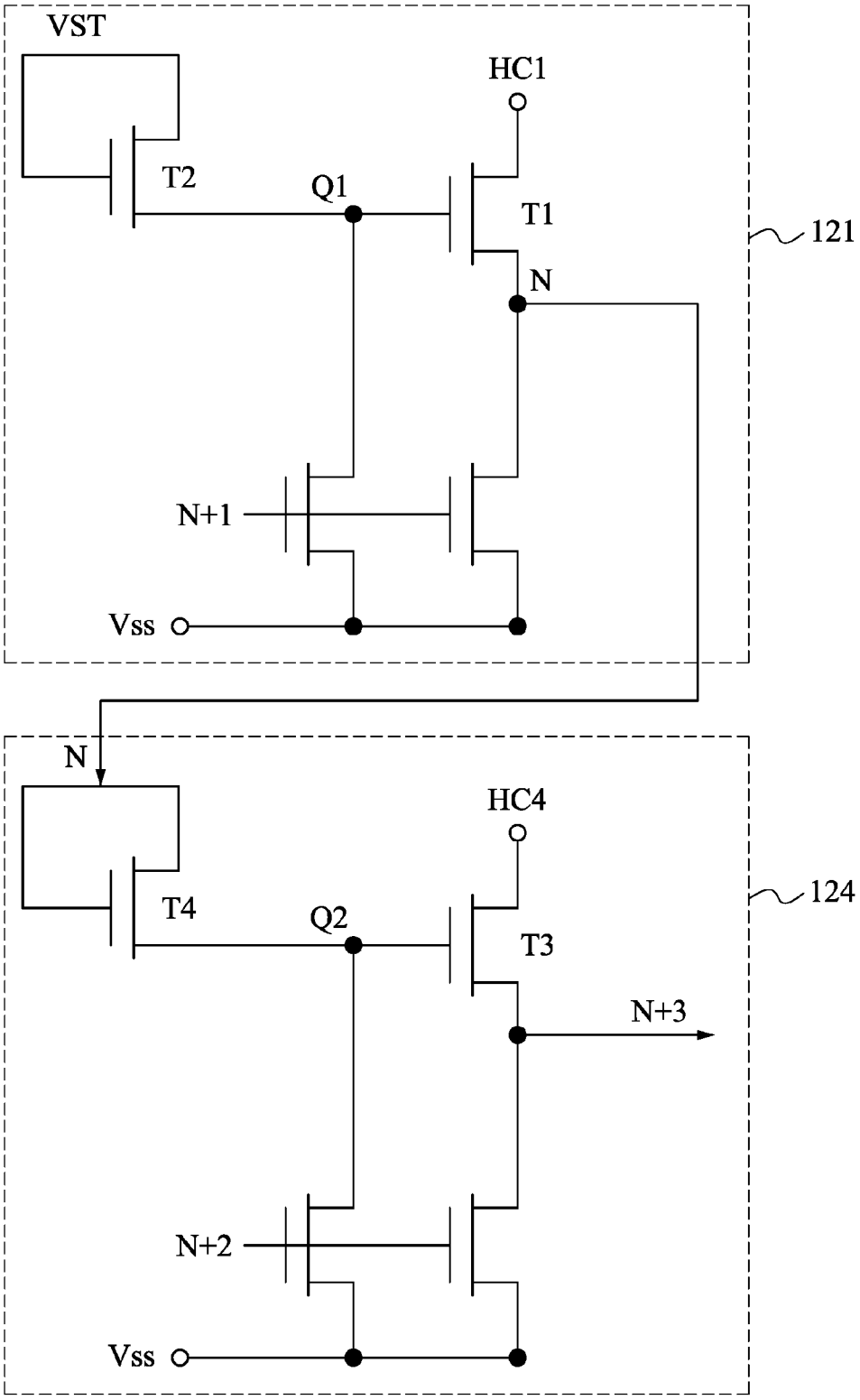
FIG. 4 is a schematic diagram of a driving circuit of the display device shown in FIG. 1 according to another embodiment.

FIG. 4 is a partial circuit diagram of the gate driver shown in FIG. 2 according to another embodiment. Referring to FIG. 4, to make the specification and drawings concise, FIG. 4 only illustrates two output stages in the gate driver 120 shown in FIG. 2, that is, internal circuits of the driving circuitry 121 and the driving circuitry 124 and a connection relationship between the internal circuits. However, other output stages in the gate driver 120 shown in FIG. 2 may also adopt a same configuration manner and connection relationship. The driving circuitry 121 is configured to receive the clock signal HC1, and output the clock signal HC1 to the gate line G1 as the gate signal N according to the initial pulse signal VST with the high level. It can be learned that, if the timing controller 130 continuously provides the initial pulse signal VST with the high level, the driving circuitry 121 continuously provides the clock signal HC1 as the gate signal N according to the initial pulse signal VST with the high level.

In an embodiment, the driving circuitry 121 includes an input end Q1, an output end which is the terminal providing gate signal N, a switch T1, and a switch T2. The switch T1 includes a first end, a control end, and a second end. In terms of a connection relationship, the control end of the switch T1 is coupled to the input end Q1, and the second end of the switch T1 is electrically coupled to the output end providing gate signal N. In terms of operations, the initial pulse signal VST output by the timing controller 130 is provided to the switch T2, the switch T2 receives the initial pulse signal VST and provides the high level signal to the input end Q1 of the driving circuitry 121, and the input end Q1 of the driving circuitry 121 correspondingly receives the initial pulse signal VST output by the timing controller 130. The output end of the driving circuitry 121 is configured to output the gate signal N. The first end of the switch T1 of the driving circuitry 121 is configured to receive the clock signal HC1. If the timing controller 130 continuously provides the initial pulse signal VST with the high level, the switch T2 receives the initial pulse signal VST and continuously provides the high level signal to the input end Q1, so that the input end Q1 of the driving circuitry 121 is continuously pulled to the high level, and therefore the switch T1 correspondingly becomes conductive according to the initial pulse signal VST with the high level, so that the clock signal HC1 is transmitted from the first end to the second end, and then the output end of the driving circuitry 121 outputs the clock signal HC1 as the gate signal N. Each of the driving circuitry 121 and 124 may receive the reference voltage Vss that may be used as a low voltage level for the driving circuitry.

In another embodiment, when the scan frequency of the display device 100 changes from the first frequency (as shown in FIG. 3A) to the second frequency (as shown in FIG. 3B) and the first frequency is higher than the second frequency, the timing controller 130 provides the initial pulse signal VST with the high level and correspondingly switches the clock signals HC1~HC6 from a third frequency (as shown in FIG. 3A) to a fourth frequency (as shown in FIG. 3B) during the period t which is longer than half of a frame period of the display device 100, as shown in FIG. 3B. By comparing the clock signal HC1 in FIG. 3A and the clock signal HC1 in FIG. 3B, it can be learned that the third frequency is lower than the fourth frequency.

In still another embodiment, as illustrated in FIG. 4, if the timing controller 130 provides the initial pulse signal VST with the high level, the driving circuitry 121 provides the clock signal HC1 as the gate signal N according to the initial pulse signal VST with the high level. From the perspective of the whole circuit shown in FIG. 2, the driving circuitries 121 to 128 provide the clock signals HC1~HC6 as the gate signals N to N+5 according to the initial pulse signal VST with the high level. It can be learned that, a frequency of the gate signals N to N+5 substantially corresponds to the frequency of the clock signals HC1~HC6. Hence, when the scan frequency of the display device 100 changes from the first frequency (as shown in FIG. 3A) to the second frequency (as shown in FIG. 3B) and the first frequency is higher than the second frequency, the gate driver 120 changes the frequency of the gate signals from the third frequency (as shown in FIG. 3A) to the fourth frequency (as shown in FIG. 3B and FIG. 3C). By comparing the scan frequency in FIG. 3A and the scan frequency in FIG. 3B, it can be learned that the third frequency is lower than the fourth frequency.

In still another embodiment, FIG. 4 further shows a driving circuitry 124. The driving circuitry 124 is another output stage in the gate driver 120 shown in FIG. 2. Elements in the driving circuitry 124 and a connection relationship among the elements are similar to those of the driving circuitry 121, and to make the description concise, details are not described herein again. However, a difference between the driving circuitry 124 and the driving circuitry 121 lies in that: the driving circuitry 124 is configured to receive the clock signal HC4 and output a gate signal N+3 to a gate line G4 (not shown in the figure) according to the gate signal N output by the driving circuitry 121. Specifically, in terms of operations, the gate signal N output by the driving circuitry 121 is provided to a switch T4 of the driving circuitry 124, the switch T4 receives the gate signal N and provides a high level signal to an input end Q2 of the driving circuitry 124, and the input end Q2 of the driving circuitry 124 correspondingly receives the gate signal N output by the driving circuitry 121. A first end of a switch T3 of the driving circuitry 124 is configured to receive the clock signal HC4. If the driving circuitry 121 continuously provides the gate signal N with a high level, the switch T4 of the driving circuitry 124 receives the gate signal N and continuously provides the high level signal to the input end Q2, so that the input end Q2 of the driving circuitry 124 is continuously pulled to the high level; therefore the switch T3 of the driving circuitry 124 correspondingly becomes conductive according to the gate signal N with the high level, so that the clock signal HC4 is transmitted from the first end to the second end, and then the output end of the driving circuitry 124 outputs the clock signal HC4 to the gate line G4 as the gate signal N+3.

Figure 5:
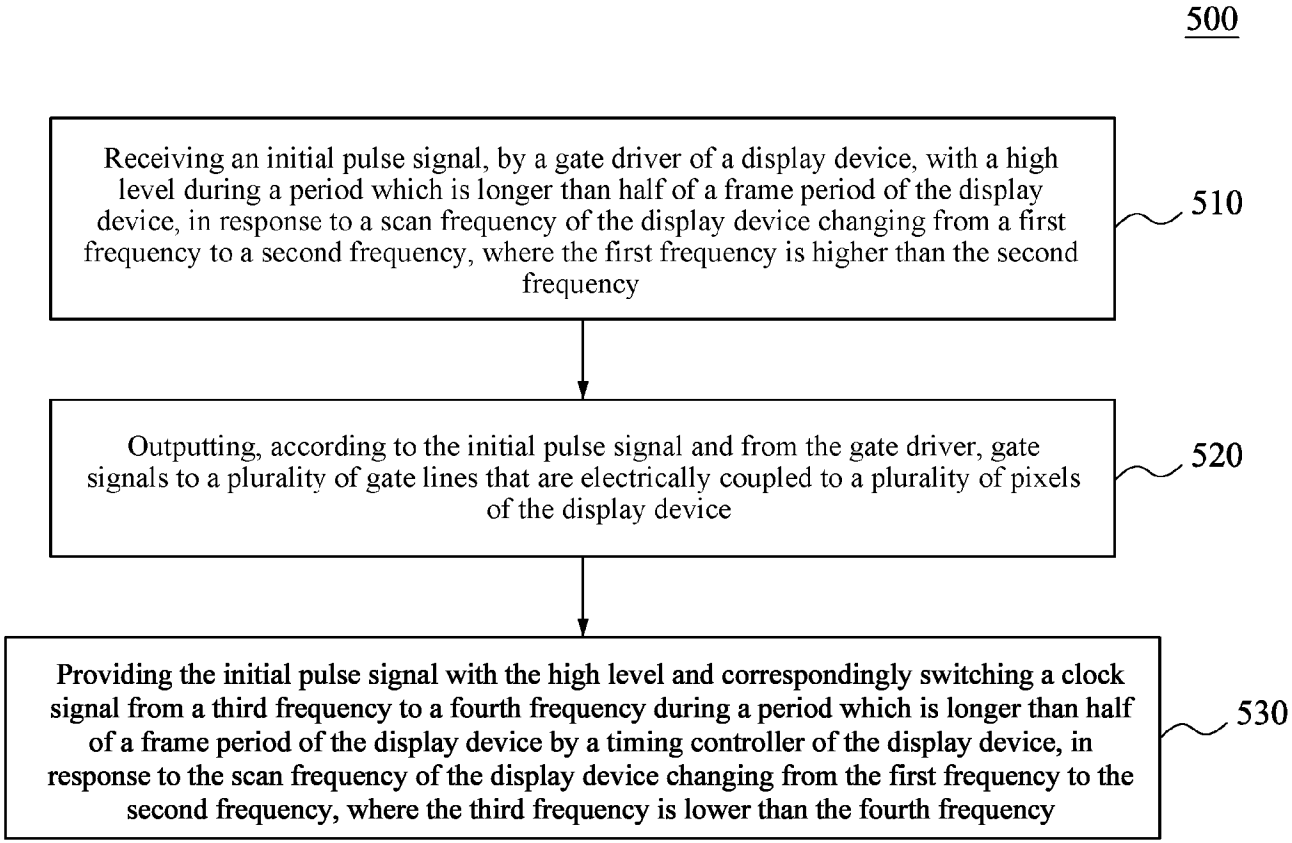
FIG. 5 is a flowchart of a driving method according to further another implementation manner.

FIG. 5 is a flowchart of a driving method according to still another implementation manner. As shown in FIG. 5, the driving method 500 shown in FIG. 5 includes the following steps:

Step 510: Receiving an initial pulse signal, by a gate driver of a display device, with a high level during a period which is longer than half of a frame period of the display device, in response to a scan frequency of the display device changing from a first frequency to a second frequency, where the first frequency is higher than the second frequency.

Step 520: Outputting, according to the initial pulse signal and from the gate driver, gate signals to a plurality of gate lines that are electrically coupled to a plurality of pixels of the display device.

Step 530: Providing the initial pulse signal with the high level and correspondingly switching a clock signal from a third frequency to a fourth frequency during a period which is longer than half of a frame period of the display device by a timing controller of the display device, in response to the scan frequency of the display device changing from the first frequency to the second frequency, where the third frequency is lower than the fourth frequency.

To understand the driving method 500 according to the embodiments more easily, please refer to FIG. 1 to FIG. 3B together. In Step 510, in response to the scan frequency of the display device 100 changing from the first frequency (as shown in FIG. 3A) to the second frequency (as shown in FIG. 3B), the gate driver 120 of the display device 100 may receive the initial pulse signal VST with the high level during the period which is longer than half of a frame period of the display device 100, where the first frequency is higher than the second frequency. Subsequently, in Step 520, the gate driver 120 outputs, according to the initial pulse signal VST, the gate signal to the plurality of pixels and the plurality of gate lines G1~Gm that are electrically coupled to the display device.

Please refer to Step 530. In response to the scan frequency of the display device 100 changing from the first frequency (as shown in FIG. 3A) to the second frequency (as shown in FIG. 3B), the timing controller 130 of the display device 100 may provide the initial pulse signal with the high level and correspondingly switch the clock signal HC1 from the third frequency to the fourth frequency during the period t which is longer than half of a frame period of the display device 100, where the third frequency is lower than the fourth frequency.

In this way, referring to FIG. 3B, in the method 500 according to certain embodiments, in response to a decrease in the scan frequency of the display device 100, the gate driver 120 receives the initial pulse signal VST with the high level and a plurality of clock signals HC1~HC6 and provides a plurality of gate signals N to N+5 to the gate lines G1~Gm according to the initial pulse signal VST during the period t which is longer than half of a frame period of the display device 100, so that liquid crystals in the display device 100 can have a longer time to reach a stable state according to an electric field generated by the gate lines G1~Gm. When the liquid crystals in the display device 100 reach the stable state, the orientation polarization no longer affects the capacitance in pixels, so that the capacitor can be substantially fully charged and no severe brightness decrease is incurred in the display device 100.

A person of ordinary skill in the technical field can understand that, the steps in the driving method 500 are named according to an execution sequence thereof; the names are merely used to make the technology easier to understand but are not intended to limit the steps. The steps may be integrated into one step or may be divided into more steps, or any step may be executed in another step, which still belongs to the implementation manner of the present disclosure.

Figure 6:
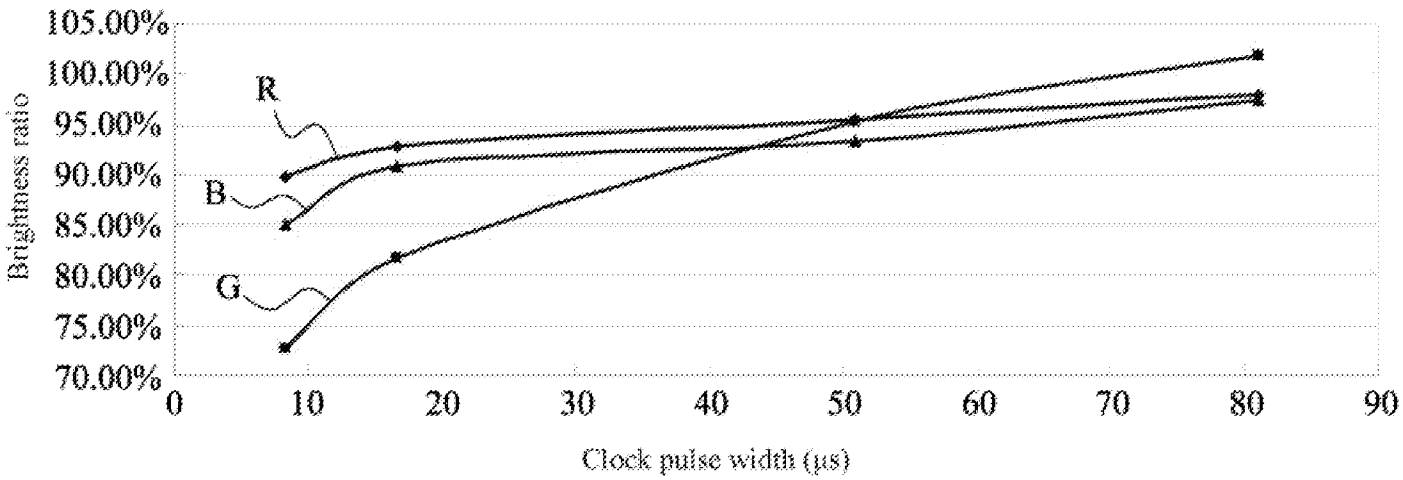
FIG. 6 is a plot of pulse width vs. brightness ratio according to another implementation manner.

FIG. 6 is a plot of pulse width vs. brightness ratio according to another implementation manner. Please refer to FIG. 3A and FIG. 3B together. The scan frequency of the display device 100 is the first frequency in FIG. 3A, and is the second frequency in FIG. 3B, where the first frequency (for example, 144 Hz) is higher than the second frequency (for example, 30 Hz). The curve illustrated in FIG. 6 is a brightness ratio plot illustrating the brightness of the display device 100 when the display device 100 operates at the second frequency and the brightness of the display device 100 when the display device 100 operates at the first frequency. As shown in FIG. 6, when clock signals (for example, the clock signals HC1~HC6) have a relatively small clock pulse width, if the display device 100 switches from operating at the first frequency to operating at the second frequency, the brightness of the display device 100 decreases significantly. In comparison, when the clock signals have a relatively large clock pulse width, even if the display device 100 switches from operating at the first frequency to operating at the second frequency, the brightness of the display device 100 only decreases slightly. By prolonging duration in which the initial pulse signal VST with the high level is provided, a pulse signal provision time is prolonged, which is similar to increasing a pulse width of the pulse signal, so that when the display device 100 switches from operating at the first frequency to operating at the second frequency, the brightness of the display device 100 only decreases slightly.

Figure 7:
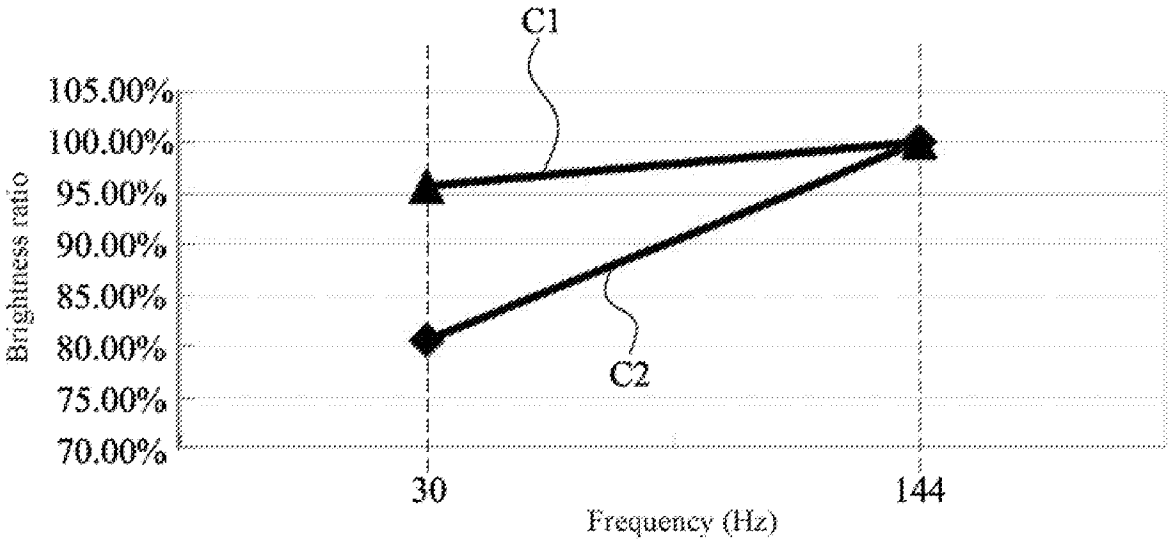
FIG. 7 is a plot of frequency vs. brightness ratio according to still another implementation manner.

FIG. 7 is a plot of frequency vs. brightness ratio according to still another implementation manner. Compared with FIG. 6, FIG. 7 provides a trend chart from a different point of view. The curve C1 in FIG. 7 is a curve corresponding to an experiment in which the technical measure is used, that is, the provision duration of the initial pulse signal VST is prolonged. In addition, the curve C2 in FIG. 7 is a curve corresponding to an experiment in which the provision duration of the initial pulse signal VST is not prolonged. As shown in the curve C2, if the display device 100 switches from operating at the first frequency (for example, 144 Hz) to operating at the second frequency (for example, 30 Hz), the brightness of the display device 100 decreases significantly. If the technical feature is used, as shown in curve C1, when the display device 100 switches from operating at the first frequency (for example, 144 Hz) to operating at the second frequency (for example, 30 Hz), the brightness of the display device 100 decreases more slightly.

It can be learned from the foregoing implementation manners that, the certain embodiments may achieve the following advantages: mitigating the problem of abnormal brightness caused by a capacitance change in pixels due to an orientation polarization effect.

Although the specific embodiments have been disclosed in the foregoing implementation manners, the embodiments are not intended to limit the present invention. Any person of ordinary skill in the technical field of the present invention can make various changes and modifications without departing from the principle and spirit of the present invention. Therefore, the protection scope of the present invention shall be subject to the appended claims.

What is claimed is:

1. A display device, comprising:

a plurality of pixels;

a plurality of gate lines, electrically coupled to the plurality of pixels;

a timing controller, configured to provide an initial pulse signal; and a gate driver, electrically coupled to the timing controller and the plurality of gate lines, and configured to receive the initial pulse signal, wherein the timing controller is configured to provide the initial pulse signal with a first enable width when a scan frequency of the display device is a first frequency and further configured to provide the initial pulse signal with a second enable width when the scan frequency of the display device is a second frequency, the first frequency is higher than the second frequency, the second enable width is larger than the first enable width, and the gate driver is further configured to output a plurality of gate signals to the plurality of gate lines in response to the initial pulse signal, wherein the gate driver comprises a driving circuitry configured to receive a clock signal, and to output the clock signal to one of the plurality of gate lines as one of the plurality of gate signals in response to the initial pulse signal with a high level; and wherein the clock signal has a first pulse during the first enable width of the initial pulse signal for the first frequency, the clock signal has second pulses during the second enable width of the initial pulse signal for the second frequency, and a length of time of the second pulses of the clock signal during the second enable width of the initial pulse signal for the second frequency is longer than a length of time of the first pulse of the clock signal during the first enable width of the initial pulse signal for the first frequency.

2. The display device according to claim 1, wherein the second enable width is larger than twice of the first enable width.

3. The display device according to claim 1, wherein the driving circuitry comprises:

an input end, configured to receive the initial pulse signal;

an output end, configured to output one of the plurality of gate signals;

a switch, comprising:

a first end, configured to receive the clock signal;

a control end, electrically coupled to the input end; and a second end, electrically coupled to the output end;

wherein the switch is configured to be conductive in response to the initial pulse signal with the high level, so that the clock signal is transmitted from the first end to the second end, and the output end outputs the clock signal to the plurality of gate lines as one of the plurality of gate signals.

4. The display device according to claim 1, wherein in response to the scan frequency of the display device changing from the first frequency to the second frequency, the timing controller is further configured to provide the initial pulse signal with the high level during a period which is longer than half of a frame period of the display device, and correspondingly switch the clock signal from a third frequency to a fourth frequency, the third frequency being lower than the fourth frequency.

5. The display device according to claim 1, wherein in response to the scan frequency of the display device changing from the first frequency to the second frequency, the timing controller is further configured to switch the clock signal from a third frequency to a fourth frequency, the third frequency being lower than the fourth frequency.

6. The display device according to claim 1, wherein the gate driver is further configured to change a frequency of the plurality of gate signals from a third frequency to a fourth frequency, the third frequency being lower than the fourth frequency, in response to the scan frequency of the display device changing from the first frequency to the second frequency.

7. The display device according to claim 1, wherein in response to the scan frequency of the display device changing from the first frequency to the second frequency, the timing controller is further configured to provide the initial pulse signal with a high level during a period which is longer than half of the frame period of the display device.

* * * * *